US006828995B1

(12) United States Patent
Iwasaki et al.

(10) Patent No.: US 6,828,995 B1
(45) Date of Patent: Dec. 7, 2004

(54) PRINTING APPARATUS AND PRINTING METHOD

(75) Inventors: Osamu Iwasaki, Tokyo (JP); Kiichiro Takahashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/568,541

(22) Filed: May 11, 2000

(30) Foreign Application Priority Data

May 14, 1999 (JP) ..... 11-134687

(51) Int. Cl.[7] ..... B41J 2/36
(52) U.S. Cl. ..... 347/190
(58) Field of Search ..... 347/180, 181, 347/182, 190, 196, 194; 400/120.05, 120.06, 120.07, 120.09, 120.11, 120.01, 120.02

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 346/3 |
| 4,558,333 A | | 12/1985 | Sugitani et al. | 347/47 |
| 4,723,129 A | | 2/1988 | Endo et al. | 346/45 |
| 4,731,618 A | * | 3/1988 | Shimazaki | 347/182 |
| 4,740,796 A | | 4/1988 | Endo et al. | 347/56 |
| 4,910,528 A | | 3/1990 | Firl et al. | 346/1.1 |
| 5,075,698 A | * | 12/1991 | Aoki et al. | 347/183 |
| 5,477,245 A | * | 12/1995 | Fuse | 347/10 |
| 5,625,384 A | | 4/1997 | Numata et al. | 347/23 |
| 5,877,785 A | | 3/1999 | Iwasaki et al. | 347/14 |
| 5,943,073 A | | 8/1999 | Otsuka et al. | 347/48 |
| 6,033,055 A | | 3/2000 | Nagoshi et al. | 347/43 |
| 6,095,639 A | | 8/2000 | Uetsuki et al. | 347/65 |

FOREIGN PATENT DOCUMENTS

| | | |
|---|---|---|
| EP | 0 626 265 A2 | 11/1994 |
| EP | 0 876 917 A2 | 11/1998 |
| JP | 59-123670 | 7/1984 |
| JP | 59-138461 | 8/1984 |
| JP | 01-275152 | 11/1989 |
| JP | 06 198888 | 7/1994 |

* cited by examiner

*Primary Examiner*—Lamson Nguyen
*Assistant Examiner*—K Feggins
(74) *Attorney, Agent, or Firm*—Fitzpatrick, Cella, Harper & Scinto

(57) ABSTRACT

By making judgment whether number of dots to be printed in one printing scan exceeds a predetermined criterion or not, printing elements associated with summing of number of dots are selected if the number of dots exceeds the predetermined criterion, printing scan for the scanning lines corresponding to the selected printing elements is performed, and paper feeding for the printed scanning line is performed. By this, possible largest number of scanning lines can be printed within an allowable electric energy consumption for one scan. Thus, efficient printing operation can be performed.

26 Claims, 17 Drawing Sheets

FEEDING DIRECTION OF THE PRINTING MEDIUM

DOWNSTREAM

UPSTREAM

CORRELATION BETWEEN NOZZLE AND PRINTING POSITION

| BAND n CONTROLLER | BAND BUFFER MANAGEMENT NUMBER TO MAKE REFERENCE TO | DOT COUNT VALUE | CRITERION VALUE 207360 MONITOR COUNTER | PRINTING ELEMENT |
|---|---|---|---|---|
| 1 | 1 | 17280 | 17280 | Seg1~8 |
| 2 | 2 | 17280 | 34560 | Seg9~16 |
| 3 | 3 | 17280 | 51840 | Seg17~24 |
| 4 | 4 | 17280 | 69120 | Seg25~32 |
| 5 | 5 | 17280 | 86400 | Seg33~40 |
| 6 | 6 | 17280 | 103680 | Seg41~48 |
| 7 | 7 | 17280 | 120960 | Seg49~56 |
| 8 | 8 | 17280 | 138240 | Seg57~64 |
| 9 | 9 | 17280 | 155520 | Seg65~72 |
| 10 | 10 | 17280 | 172800 | Seg73~80 |
| 11 | 11 | 17280 | 190080 | Seg81~88 |
| 12 | 12 | 17280 | 207360 | Seg89~96 |
| 13 | BLANK | | | Seg97~104 |
| 14 | BLANK | | | Seg105~112 |
| 15 | BLANK | | | Seg113~120 |
| 16 | BLANK | | | Seg121~128 |
| 17 | BLANK | | | Seg129~136 |
| 18 | BLANK | | | Seg137~144 |
| 19 | BLANK | | | Seg145~152 |
| 20 | BLANK | | CLEAR | Seg153~160 |

| BAND n CONTROLLER | BAND BUFFER MANAGEMENT NUMBER TO MAKE REFERENCE TO | DOT COUNT VALUE | MONITOR COUNTER | PRINTING ELEMENT |
|---|---|---|---|---|
| 1 | 25 | 17280 | 17280 | Seg1~8 |
| 2 | 26 | 17280 | 34560 | Seg9~16 |
| 3 | 27 | 17280 | 51840 | Seg17~24 |
| 4 | 28 | 17280 | 69120 | Seg25~32 |
| 5 | 29 | 17280 | 86400 | Seg33~40 |
| 6 | 30 | 17280 | 103680 | Seg41~48 |
| 7 | 31 | 17280 | 120960 | Seg49~56 |
| 8 | 32 | 17280 | 138240 | Seg57~64 |

FIG.8A

FIG.8

FIG.8A

FIG.8B

| BAND n CONTROLLER | BAND BUFFER MANAGEMENT NUMBER TO MAKE REFERENCE TO | DOT COUNT VALUE | CRITERION VALUE 207360 MONITOR COUNTER | PRINTING ELEMENT |
|---|---|---|---|---|
| 1 | 13 | 17280 | 17280 | Seg1~8 |
| 2 | 14 | 17280 | 34560 | Seg9~16 |
| 3 | 15 | 17280 | 51840 | Seg17~24 |
| 4 | 16 | 17280 | 69120 | Seg25~32 |
| 5 | 17 | 17280 | 86400 | Seg33~40 |
| 6 | 18 | 17280 | 103680 | Seg41~48 |
| 7 | 19 | 17280 | 120960 | Seg49~56 |
| 8 | 20 | 17280 | 138240 | Seg57~64 |
| 9 | 21 | 17280 | 155520 | Seg65~72 |
| 10 | 22 | 17280 | 172800 | Seg73~80 |
| 11 | 23 | 17280 | 190080 | Seg81~88 |
| 12 | 24 | 17280 | 207360 | Seg89~96 |
| 13 | BLANK | | | Seg97~104 |
| 14 | BLANK | | | Seg105~112 |
| 15 | BLANK | | | Seg113~120 |
| 16 | BLANK | | | Seg121~128 |
| 17 | BLANK | | | Seg129~136 |
| 18 | BLANK | | | Seg137~144 |
| 19 | BLANK | | | Seg145~152 |
| 20 | BLANK | | CLEAR | Seg153~160 |

| | | | | |
|---|---|---|---|---|
| 9 | 33 | 17280 | 155520 | Seg65-72 |
| 10 | 34 | 17280 | 172800 | Seg73-80 |
| 11 | 35 | 17280 | 190080 | Seg81-88 |
| 12 | 36 | 17280 | 207360 | Seg89-96 |
| 13 | BLANK | | | Seg97-104 |
| 14 | BLANK | | | Seg105-112 |
| 15 | BLANK | | | Seg113-120 |
| 16 | BLANK | | | Seg121-128 |
| 17 | BLANK | | | Seg129-136 |
| 18 | BLANK | | | Seg137-144 |
| 19 | BLANK | | | Seg145-152 |
| 20 | BLANK | | CLEAR | Seg153-160 |

| BAND n CONTROLLER | BAND BUFFER MANAGEMENT NUMBER TO MAKE REFERENCE TO | DOT COUNT VALUE | MONITOR COUNTER | PRINTING ELEMENT |
|---|---|---|---|---|
| 1 | 9 | 17280 | 17280 | Seg1-8 |
| 2 | 10 | 17280 | 34560 | Seg9-16 |
| 3 | 11 | 17280 | 51840 | Seg17-24 |
| 4 | 12 | 17280 | 69120 | Seg25-32 |
| 5 | 13 | 17280 | 86400 | Seg33-40 |
| 6 | 14 | 17280 | 103680 | Seg41-48 |
| 7 | 15 | 17280 | 120960 | Seg49-56 |
| 8 | 16 | 17280 | 138240 | Seg57-64 |
| 9 | 17 | 17280 | 155520 | Seg65-72 |
| 10 | 18 | 17280 | 172800 | Seg73-80 |
| 11 | 19 | 17280 | 190080 | Seg81-88 |
| 12 | 20 | 17280 | 207360 | Seg89-96 |
| 13 | BLANK | | | Seg97-104 |
| 14 | BLANK | | | Seg105-112 |
| 15 | BLANK | | | Seg113-120 |
| 16 | BLANK | | | Seg121-128 |
| 17 | BLANK | | | Seg129-136 |
| 18 | BLANK | | | Seg137-144 |
| 19 | BLANK | | | Seg145-152 |
| 20 | BLANK | | CLEAR | Seg153-160 |

| BAND n CONTROLLER | BAND BUFFER MANAGEMENT NUMBER TO MAKE REFERENCE TO | DOT COUNT VALUE | MONITOR COUNTER | PRINTING ELEMENT |
|---|---|---|---|---|
| 1 | 37 | 17280 | 17280 | Seg1-8 |
| 2 | 38 | 17280 | 34560 | Seg9-16 |
| 3 | 39 | 17280 | 51840 | Seg17-24 |
| 4 | 40 | 17280 | 69120 | Seg25-32 |
| 5 | 1 | 17280 | 86400 | Seg33-40 |
| 6 | 2 | 17280 | 103680 | Seg41-48 |
| 7 | 3 | 17280 | 120960 | Seg49-56 |
| 8 | 4 | 17280 | 138240 | Seg57-64 |
| 9 | 5 | 17280 | 155520 | Seg65-72 |
| 10 | 6 | 17280 | 172800 | Seg73-80 |
| 11 | 7 | 17280 | 190080 | Seg81-88 |
| 12 | 8 | 17280 | 207360 | Seg89-96 |
| 13 | BLANK | | | Seg97-104 |
| 14 | BLANK | | | Seg105-112 |
| 15 | BLANK | | | Seg113-120 |
| 16 | BLANK | | | Seg121-128 |
| 17 | BLANK | | | Seg129-136 |
| 18 | BLANK | | | Seg137-144 |
| 19 | BLANK | | | Seg145-152 |
| 20 | BLANK | | CLEAR | Seg153-160 |

FIG.8B

FIG.11A

FIG.11

FIG.11A

FIG.11B

CORRELATION BETWEEN NOZZLE AND PRINTING POSITION

| BAND n CONTROLLER | BAND BUFFER MANAGEMENT NUMBER TO MAKE REFERENCE TO | DOT COUNT VALUE | MONITOR COUNTER (CRITERION VALUE 207360) | PRINTING ELEMENT |
|---|---|---|---|---|
| 1 | BLANK | | | Seg1-8 |
| 2 | BLANK | | | Seg9-16 |
| 3 | BLANK | | | Seg17-24 |
| 4 | BLANK | | | Seg25-32 |
| 5 | BLANK | | | Seg33-40 |
| 6 | BLANK | | | Seg41-48 |
| 7 | BLANK | | | Seg49-56 |
| 8 | BLANK | | | Seg57-64 |
| 9 | 1 | 17280 | 17280 | Seg65-72 |
| 10 | 2 | 17280 | 34560 | Seg73-80 |
| 11 | 3 | 17280 | 51840 | Seg81-88 |
| 12 | 4 | 17280 | 69120 | Seg89-96 |
| 13 | 5 | 17280 | 86400 | Seg97-104 |
| 14 | 6 | 17280 | 103680 | Seg105-112 |
| 15 | 7 | 17280 | 120960 | Seg113-120 |
| 16 | 8 | 17280 | 138240 | Seg121-128 |
| 17 | 9 | 17280 | 155520 | Seg129-136 |
| 18 | 10 | 17280 | 172800 | Seg137-144 |
| 19 | 11 | 17280 | 190080 | Seg145-152 |
| 20 | 12 | 17280 | 207360 | Seg153-160 |

| BAND n CONTROLLER | BAND BUFFER MANAGEMENT NUMBER TO MAKE REFERENCE TO | DOT COUNT VALUE | MONITOR COUNTER | PRINTING ELEMENT |
|---|---|---|---|---|
| 1 | BLANK | | | Seg1-8 |
| 2 | BLANK | | | Seg9-16 |
| 3 | BLANK | | | Seg17-24 |
| 4 | BLANK | | | Seg25-32 |
| 5 | BLANK | | | Seg33-40 |
| 6 | BLANK | | | Seg41-48 |
| 7 | BLANK | | | Seg49-56 |
| 8 | BLANK | | | Seg57-64 |

| BAND n CONTROLLER | BAND BUFFER MANAGEMENT NUMBER TO MAKE REFERENCE TO | DOT COUNT VALUE | MONITOR COUNTER (CRITERION VALUE 207360) | PRINTING ELEMENT |
|---|---|---|---|---|
| 1 | BLANK | | | Seg1-8 |
| 2 | BLANK | | | Seg9-16 |
| 3 | BLANK | | | Seg17-24 |
| 4 | BLANK | | | Seg25-32 |
| 5 | BLANK | | | Seg33-40 |
| 6 | BLANK | | | Seg41-48 |
| 7 | BLANK | | | Seg49-56 |
| 8 | BLANK | | | Seg57-64 |
| 9 | 13 | 17280 | 17280 | Seg65-72 |
| 10 | 14 | 17280 | 34560 | Seg73-80 |
| 11 | 15 | 17280 | 51840 | Seg81-88 |
| 12 | 16 | 17280 | 69120 | Seg89-96 |
| 13 | 17 | 17280 | 86400 | Seg97-104 |
| 14 | 18 | 17280 | 103680 | Seg105-112 |
| 15 | 19 | 17280 | 120960 | Seg113-120 |
| 16 | 20 | 17280 | 138240 | Seg121-128 |
| 17 | 21 | 17280 | 155520 | Seg129-136 |
| 18 | 22 | 17280 | 172800 | Seg137-144 |
| 19 | 23 | 17280 | 190080 | Seg145-152 |
| 20 | 24 | 17280 | 207360 | Seg153-160 |

| | | | | |
|---|---|---|---|---|
| 9 | 25 | 17280 | 17280 | Seg65-72 |
| 10 | 26 | 17280 | 34560 | Seg73-80 |
| 11 | 27 | 17280 | 51840 | Seg81-88 |
| 12 | 28 | 17280 | 69120 | Seg89-96 |
| 13 | 29 | 17280 | 86400 | Seg97-104 |
| 14 | 30 | 17280 | 103680 | Seg105-112 |
| 15 | 31 | 17280 | 120960 | Seg113-120 |
| 16 | 32 | 17280 | 155520 | Seg121-128 |
| 17 | 33 | 17280 | 155520 | Seg129-136 |
| 18 | 34 | 17280 | 172800 | Seg137-144 |
| 19 | 35 | 17280 | 190080 | Seg145-152 |
| 20 | 36 | 17280 | 207360 | Seg153-160 |

| BAND n CONTROLLER | BAND BUFFER MANAGEMENT NUMBER TO MAKE REFERENCE TO | DOT COUNT VALUE | MONITOR COUNTER | PRINTING ELEMENT |
|---|---|---|---|---|
| 1 | BLANK | | | Seg1-8 |
| 2 | BLANK | | | Seg9-16 |
| 3 | BLANK | | | Seg17-24 |
| 4 | BLANK | | | Seg25-32 |
| 5 | BLANK | | | Seg33-40 |
| 6 | BLANK | | | Seg41-48 |
| 7 | BLANK | | | Seg49-56 |
| 8 | BLANK | | | Seg57-64 |
| 9 | 9 | 17280 | 17280 | Seg65-72 |
| 10 | 10 | 17280 | 34560 | Seg73-80 |
| 11 | 11 | 17280 | 51840 | Seg81-88 |
| 12 | 12 | 17280 | 69120 | Seg89-96 |
| 13 | 13 | 17280 | 86400 | Seg97-104 |
| 14 | 14 | 17280 | 103680 | Seg105-112 |
| 15 | 15 | 17280 | 120960 | Seg113-120 |
| 16 | 16 | 17280 | 138240 | Seg121-128 |
| 17 | 17 | 17280 | 155520 | Seg129-136 |
| 18 | 18 | 17280 | 172800 | Seg137-144 |
| 19 | 19 | 17280 | 190080 | Seg145-152 |
| 20 | 20 | 17280 | 207360 | Seg153-160 |

| BAND n CONTROLLER | BAND BUFFER MANAGEMENT NUMBER TO MAKE REFERENCE TO | DOT COUNT VALUE | MONITOR COUNTER | PRINTING ELEMENT |
|---|---|---|---|---|
| 1 | BLANK | | | Seg1-8 |
| 2 | BLANK | | | Seg9-16 |
| 3 | BLANK | | | Seg17-24 |
| 4 | BLANK | | | Seg25-32 |
| 5 | BLANK | | | Seg33-40 |
| 6 | BLANK | | | Seg41-48 |
| 7 | BLANK | | | Seg49-56 |
| 8 | BLANK | | | Seg57-64 |
| 9 | 37 | 17280 | 17280 | Seg65-72 |
| 10 | 38 | 17280 | 34560 | Seg73-80 |
| 11 | 39 | 17280 | 51840 | Seg81-88 |
| 12 | 40 | 17280 | 69120 | Seg89-96 |
| 13 | 1 | 17280 | 86400 | Seg97-104 |
| 14 | 2 | 17280 | 103680 | Seg105-112 |
| 15 | 3 | 17280 | 120960 | Seg113-120 |
| 16 | 4 | 17280 | 138240 | Seg121-128 |
| 17 | 5 | 17280 | 155520 | Seg129-136 |
| 18 | 6 | 17280 | 172800 | Seg137-144 |
| 19 | 7 | 17280 | 190080 | Seg145-152 |
| 20 | 8 | 17280 | 207360 | Seg153-160 |

FIG.11B

| FIG.12A |
| --- |
| FIG.12B |

PRINTING APPARATUS AND PRINTING METHOD

This application is based on Patent Application No. 11-134687 (1999) filed May 14, 1999 in Japan, the content of which is incorporated hereinto by reference.

BACKGROUND OF THE INVENTION

1. Field of the Invention

The present invention relates to a printing apparatus and a printing method performing control for restricting consumption of power and rise of temperature associated with driving of a printing head.

2. Description of the Related Art

One of important performances of printing apparatus, such as printer or the like, is a printing speed.

Therefore, in a serial scanning type printing apparatus printing an image by scanning a printing head in a direction perpendicular to a transporting direction of a printing medium, for example, a method of increasing number of printing elements to be formed in the printing head has been taken for expanding a region to be printed in one scan and for improving a printing speed.

However, in this case, when the printer is designed under a premise that all of printing elements of the printing head are driven over entire scanning range in one path of scan, various problems, such as increasing of cost and so on, can be encountered.

One of the problems is that capacity of power supply, cost and size of the apparatus are increased, as all of the printing elements are driven at a time. Also, in the case of a thermal type or an ink-jet-type printing head employing an electrothermal transducer as the printing element, another problem of elevating of temperature of the printing head may be caused by simultaneously driving all printing elements. In order to restrict elevating of the temperature in the printing head, it becomes necessary to provide a relatively large head sink (heat radiation plate), for example.

On the other hand, most of the characters or graphic patterns, such as graphic charts and the like to be printed in normal printing or half tone images of photographs and the like may contain pixels to be printed less than or equal to 50% of total number of pixels which can be printed at one path of printing scan.

In view of this, a method to restrict power consumption in one path of scan and not requiring to preliminarily increase a power source capacity in consideration of driving of all printing elements, has been known conventionally.

As one method, a method to aggregate number of printing pixels (number of dots) corresponding number of times of driving of respective printing elements in one printing scan, to lower motion speed of the printing head in the printing scan, accordingly to restrict the power consumption by lowering of a driving frequency of the printing element when dot number exceeds a predetermined number, has been known.

As other method, there has been known a printing method, in which number of dots is aggregated in similar manner as that set forth above, a region to be completed by one path of printing scan depending upon the number of dots is printed over several times of divided scan to restrict power consumption.

On the other hand, in the case of the thermal type printer employing the electrothermal transducer, a printing method restricting elevating of the temperature of the printing head by restricting power consumption depending upon the temperature of the printing head has been known, in order to prevent the printing head from breakage due to elevation of temperature thereof.

However, in the case of the conventional printing method set forth above, the construction becomes complicate for branching of control for printing.

In case of the printing method to lower motion speed of the printing head as set forth above, two or more controls are required in connection with drive control of the motor as a driving source, and optimization becomes necessary in acceleration and deceleration control in respective drive control. On the other hand, in this case, optimization of structure is required even for the motor so as to adapt to various driving speed.

On the other hand, in the case of the printing method to dividingly perform printing for the area to be printing in one path of printing scan, in comparison with control to alternately perform scanning operation of the normal printing head (primary scan) and transporting of the printing medium (auxiliary scan), it becomes necessary to perform exceptional control so as not to perform auxiliary scan during the primary scan. In this case, control becomes complicate.

SUMMARY OF THE INVENTION

The present invention has been worked out in view of the problems set forth above. Therefore, it is an object of the preset invention to provide a printing apparatus and a printing method which is simply in control, efficient in printing and can lower power consumption of a printing head.

According to an aspect of the present invention, a printing apparatus employing a printing head having a plurality of printing elements and performing printing by scanning the printing head relative to a printing medium, comprising: counting means, for summing the number of printing dots of printing data corresponding to the number of driving the printing elements prior to scanning of the printing head, the summing being performed by adding, as a unit, the printing data on a band in the scanning direction corresponding to each group of the printing elements in the case the plurality of recording elements are divided into a plurality of groups; judgment means for making judgment whether the number of printing dots summed by the counting means is in excess of a predetermined value; and print control means for selecting a band capable of printing by the scanning depending upon judgment of the judgment means and performing printing by the printing elements corresponding to the selected band.

The print control means may select band associated with summing up to the predetermined value when judgment is made that the number of printed dots exceeds the predetermined value by the judgment means and perform the printing scan using the printing elements corresponding to the selected band.

The print control means may further comprise transport control means for feeding a printing medium for a region corresponding to the band selected in the printing scan.

On the other hand, temperature detecting means for detecting a temperature of the printing head may be further provided and the predetermined value may be varied depending upon the temperature of the printing head detected by the temperature detecting means.

According to another aspect of the present invention. a printing method employing a printing head having a plurality of printing elements and performing printing by scanning the printing head relative to a printing medium, comprising: counting step, for summing the number of printing dots of printing data corresponding to the number of driving the printing elements prior to scanning of the printing head, the summing being performed by adding, as a unit, the printing data on a band in the scanning direction corresponding to each group of the printing elements in the case the plurality of recording elements are divided into a plurality of groups; judgment step of making judgment whether the number of printing dots summed by the counting is in excess of a predetermined value; and printing step of selecting a band capable of printing by the scanning depending upon the judgment and performing printing by the printing elements corresponding to the selected band.

According to the present invention, when judgment is made that the number of printing dots summed per band in advance of printing scan is in excess of the predetermined value, the printing elements of the bands associated with summing up to the predetermined dot number are driven to perform printing scan. Therefore, the power required for driving the printing head in one printing scan can be restricted to a value corresponding to the predetermined value. As a result, possible largest number of scanning lines can be printed within the range of electric energy consumption allowed for one scan. Thus, efficient printing operation can be performed.

Furthermore, by providing the temperature detecting means for detecting the temperature of the printing head, and by varying the predetermined value depending upon the detected temperature of the printing head, heating value associating with printing operation of the printing head can be restricted.

The above and other objects, effects, features and advantages of the present invention will become more apparent from the following description of embodiments thereof taken in conjunction with the accompanying drawings.

BRIEF DESCRIPTION OF THE DRAWINGS

FIG. 8 is a diagram showing the relationship of FIGS. 8A and 8B;

FIG. 8A is illustration for explaining one example of a particular print control in the first embodiment;

FIG. 8B is illustration for explaining one example of a particular print control in the first embodiment;

FIG. 11 is a diagram showing the relationship of FIGS. 11A and 11B;

FIG. 11A is illustration for explaining one example of the third embodiment of a particular print control according to the present invention;

FIG. 11B is illustration for explaining one example of the third embodiment of a particular print control according to the present invention;

DESCRIPTION OF THE PREFERRED EMBODIMENT

The preferred embodiments of the present invention will be described hereinafter in detail with reference to the drawings.

(Explanation of Body of Printing Apparatus)

Figure 1:
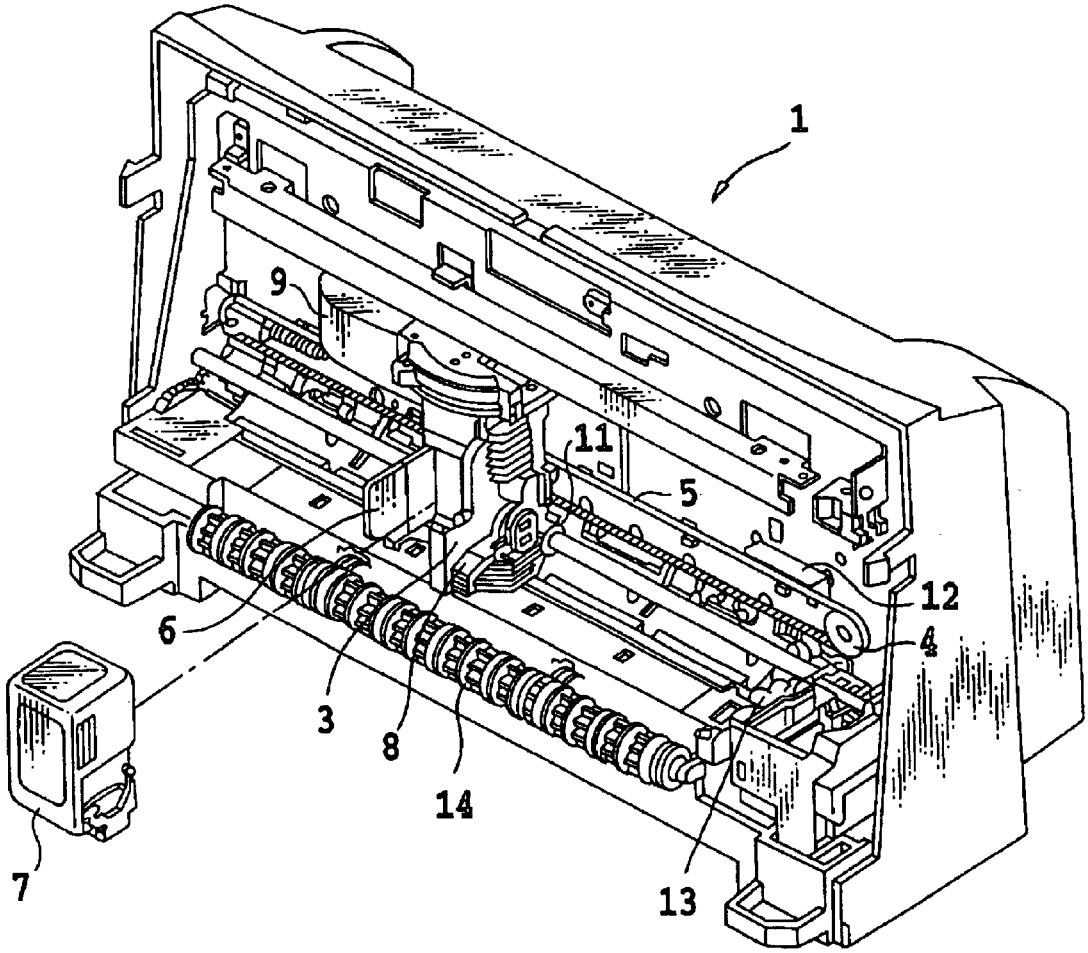
FIG. 1 is a perspective view showing an internal mechanism of one embodiment of a printer according to the present invention.

The preferred embodiment of a printing apparatus has a construction as an ink-jet type serial printer. FIG. 1 is a perspective view showing an internal mechanism of the printer.

In a motion area of a carriage unit 3, a guide shaft 2 is provided. A carriage unit 3 is movably supported on the guide shaft 2 so as to permit the carriage unit 3 to move along the guide shaft 2. On the other hand, an endless timing belt 5 is provided in parallel to the guide shaft 2 and is stretched between a pair of timing pulleys 4. The carriage unit 3 is connected to the timing belt 5. By this, a driving force of a not shown motor can be transmitted to the carriage unit 3 via the timing belt 5 for permitting movement of the carriage unit 3.

In the carriage unit 3, a cartridge holder 6 is provided. On the cartridge holder 6, an ink-jet cartridge 7 is exchangeably mounted. In more detail, the cartridge holder 6 is provided for displacement together with a manual lever 8 which is pivotable. Corresponding to pivotal motion of the manual lever 8, the ink-jet cartridge 7 is set in the cartridge holder 6 and removed therefrom. In the carriage unit 3, a plurality of connection terminals (not shown) are provided for electrical connection with the ink-jet cartridge 7. These connection terminals are electrically connected to a control circuit which will be explained later, via a flexible cable 9. Furthermore, in the carriage unit 3, a position sensor 11 constituted of a photo coupler is provided. When the carriage unit 3 is placed at a home position through its motion, the position sensor 11 detects a light blocking plate 12 arranged at the home position. By this, the carriage unit 3 located at the home position is detected.

At the, position opposing to the printing head of the ink-jet cartridge 7 mounted on the carriage unit 3, a transporting path for sequentially transporting a printing medium (not shown) in an auxiliary scanning direction, is formed by a plurality of guide plates (not shown), a feeding rollers 14 and so on.

(Explanation for Printing Head)

Figure 2:
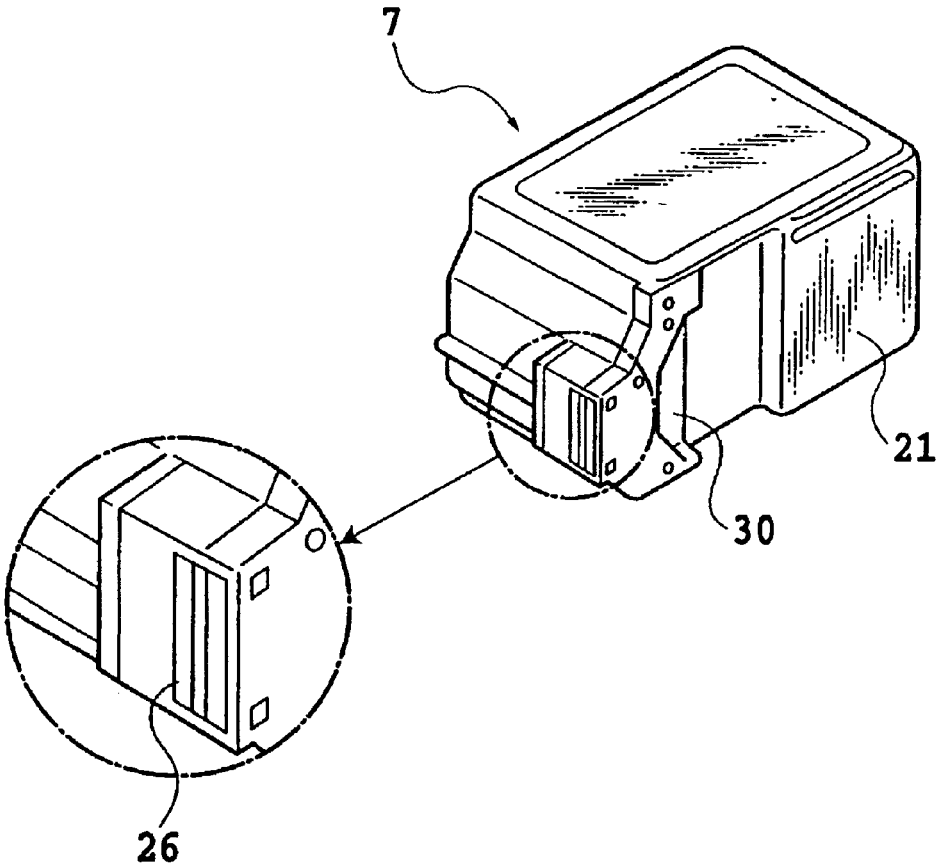
FIG. 2 is a perspective view showing a construction of an ink-jet cartridge to be employed in the printer of FIG. 1.

The ink-jet cartridge 7 generally comprises the printing head and an ink tank. FIG. 2 is a perspective view of the ink-jet cartridge 7.

The ink-jet cartridge 7 has a frame body 21 forming its case. Within the frame body 21, a porous absorbing body is inserted. An ink is absorbed by the porous absorbing body and maintained therein. On the other hand, a printing head portion 26 is provided integrally with the frame body 21. The ink held in the porous absorbing body is supplied to the printing head portion 26 through a not shown supply tube. In the printing head portion 26, a hundred-sixty ink ejection openings (hereinafter also referred to as nozzle, occasionally) are provided in the shown embodiment. The printing head portion 26 is formed by bonding a top plate and a heater board formed of silicon with each other in order to form a liquid chamber commonly connected to a plurality of nozzles. In the heater board, an electrothermal transducer is formed at each position corresponding to each nozzle position in order to generate bubble in the ink. On the heater board, an electrode for supplying an electric power to the electrothermal transducer. Terminals of the electrodes are electrically connected to a connection terminals (not shown) of the carriage unit 3 via connection terminals 30 formed on the side surface of the frame body 21.

(Explanation of a Logic Portion of Heater Board)

Figure 3:
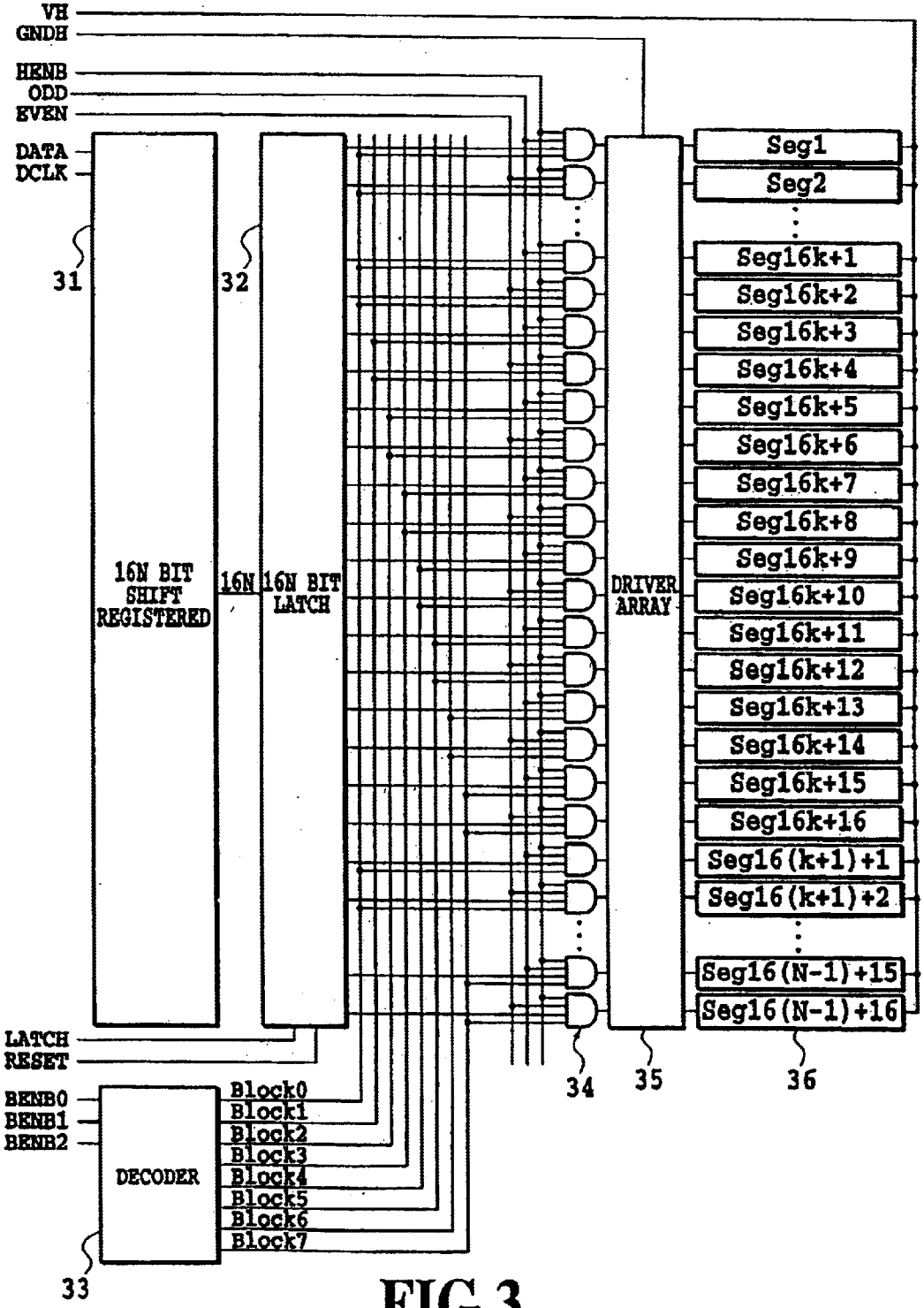
FIG. 3 is a block diagram showing a logical construction for driving a printing head to be mounted on the ink-jet cartridge.

In the heater board, a head drive circuit for electrically driving the electrothermal transducer is further formed by a process similar to a semiconductor fabrication process. FIG. 3 is an illustration showing a logic configuration of the drive circuit.

The drive circuit has a shift register 31, a latch circuit 32, a decoder 33, a plurality of AND circuits, a driver circuit (array) 35 and so on.

The shift register 31 is adapted to temporarily store ink ejection data (printing data) corresponding to a hundred-sixty electrothermal transducers 36 (namely, nozzles). Namely, in synchronism with a clock signal (DCLK) externally input from the control circuit of the printer body, the shift register 31 hold ejection data (DATA) input serially in similar manner in number corresponding to the electrothermal transducer 36 (a hundred-sixty). A latch signal (LATCH) is input externally to the latch circuit 32. In response to the latch signal, the ejection data temporarily stored in the shift register 21 is latched. The latched signal serves as a signal for selecting the nozzle for performing ejection (hereinafter also referred to as nozzle selection signal).

The decoder 33 generates a block selection signal for selecting a driving block in block driving of the electrothermal transducer 36 in the printing head. Namely, to the decoder 33, three block signals (BENB0 to 2), respective which are binary signals, are input externally. Depending upon combination of signal values of the block signals BENB0 to 2, a block selection signal for enabling driving of one of eight blocks (Block0 to 7) is generated.

When each individual electrothermal transducers 36 are distinguished by providing numbers from one end of the nozzle array, such as Seg. 1, Seg. 2, . . . Seg. 160, the block selection signal of the decoder 33 and the electrothermal transducers are corresponded so that the following electrothermal transducers are included in respective blocks.

Block0: Seg. 16k+1, Seg. 16K+2

Block1: Seg. 16k+3, Seg. 16K+4

Block2: Seg. 16k+5, Seg. 16K+6

Block3: Seg. 16k+7, Seg. 16K+8

Block4: Seg. 16k+9, Seg. 16K+10

Block5: Seg. 16k+11, Seg. 16K+12

Block6: Seg. 16k+13, Seg. 16K+14

Block7: Seg. 16k+15, Seg. 16K+16 wherein k is integer of 0 to (N−1) (N is a positive integer greater than or equal to 2).

In the shown embodiment, N=10. Accordingly, one block to be selected by the block selection signal Block0 to Block7, is constituted of twenty electrothermal transducers.

Furthermore, in the AND circuit 34, in addition to the foregoing nozzle selection signal and the block selection signal, a pulse signal ODD and a pulse signal EVEN (hereinafter these two pulse signals are referred to as ODD/EVEN selection signal). These ODD/EVEN selection signal select the electrothermal transducer in the following manner.

ODD: Seg. 16k+(2m+1)

Even: Seg. 16k+(2m+2)

here, m is integer of 0 to 7.

Namely, by combining eight block selection signals Block0 to Block7 with two ODD/EVEN selection signals ODD and EVEN, hundred-sixty electrothermal transducers are divided into sixteen blocks composed of the electrothermal transducers driven simultaneously, and respective blocks are selected sequentially for driving respective electrothermal transducers are driven according to the ejection data.

Also, similarly, a pulse signal HENB from a control circuit of the printer body is input to the AND circuit 34 for selecting all of the electrothermal transducers.

As set forth above, the nozzle to effect ejection (the electrothermal transducer to be driven) is selected by the nozzle selection signal, and drive timing of the block of the electrothermal transducers to be driven simultaneously is determined by the block signal and the ODD/EVEN selection signal. Then, by applying the pulse signal HENB in synchronism with these block signal and the ODD/EVEN selection signal, a waveform of the pulse to be applied to each electrothermal transducer can be determined.

Each AND circuit 34 performs AND output of each signal. By this, the driver circuit 35 drives the electrothermal transducer by applying a voltage VH to the selected electrothermal transducer.

(Explanation of Control System of Printing Apparatus)

Figure 4:
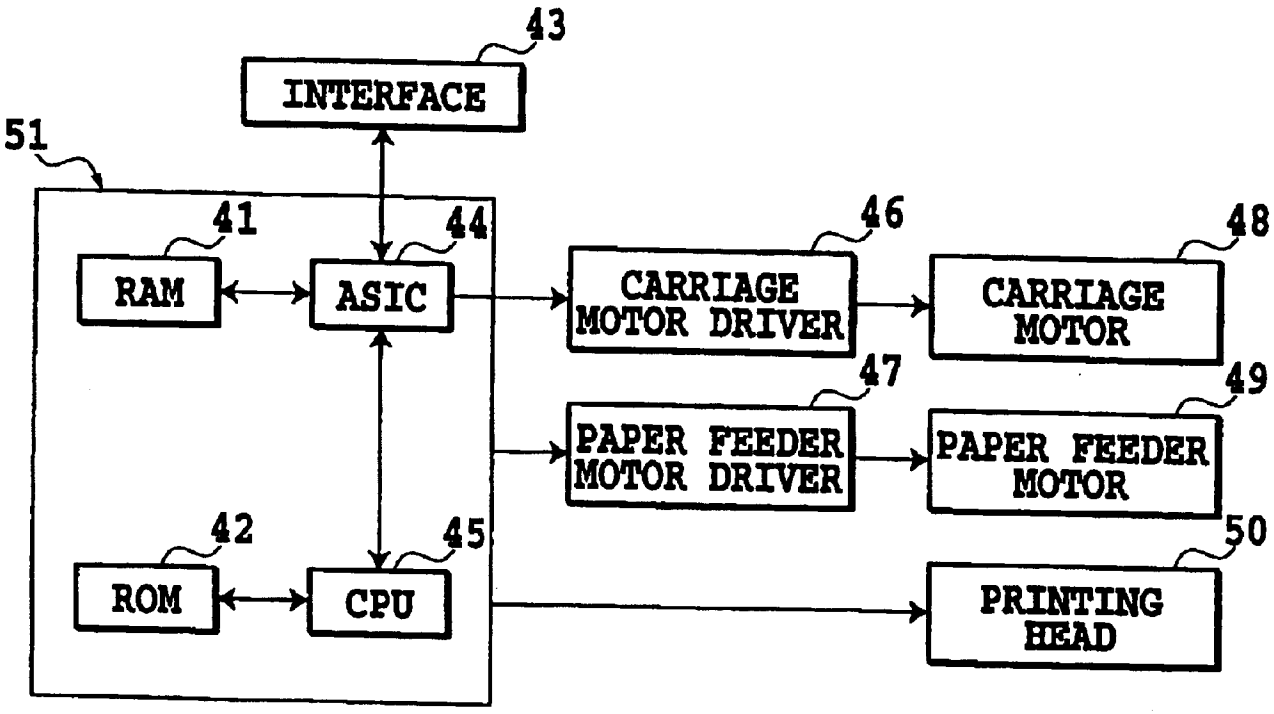
FIG. 4 is a block diagram showing a construction of a control system of the printer.

FIG. 4 is a block diagram showing a construction of a control system for performing a print control of the shown embodiment of the printer.

In FIG. 4, the reference numeral 43 denotes an interface for inputting a print signal from a host unit, 45 denotes CPU, 42 denotes a program ROM storing a control program to be executed by CPU 45 and 41 denotes RAM for storing various data (the foregoing print signal or a print data or the like to be supplied to the printing head). ASIC 44 performs supply control of a printing data to the printing head and performs data transfer control between CPU 45 and ASIC 33 through a system bus.

The reference numeral 48 denotes a carriage motor for moving the carriage unit 3 (see FIG. 1) mounting a printing head 50 (forming the printing head portion 26 shown in FIG. 2), 49 denotes a paper feeding motor for feeding a printing medium. The reference numerals 46, 47 are motor drivers for respectively driving a carriage motor 48 and the paper feeding motor 49. The reference numeral 51 denotes a control portion of the printer.

In the construction of the control system as set forth above, when the print signal is transferred to the interface 43, the print signal is converted into the ejection data through exchanging between the ASIC 44 and CPU 45. Then, the motor drivers 46 and 47 are controlled, and in conjunction therewith, the printing head 50 is driven according to the ejection data and the various signal associated with printing head driving as set forth in connection with FIG. 3.

Figure 5:
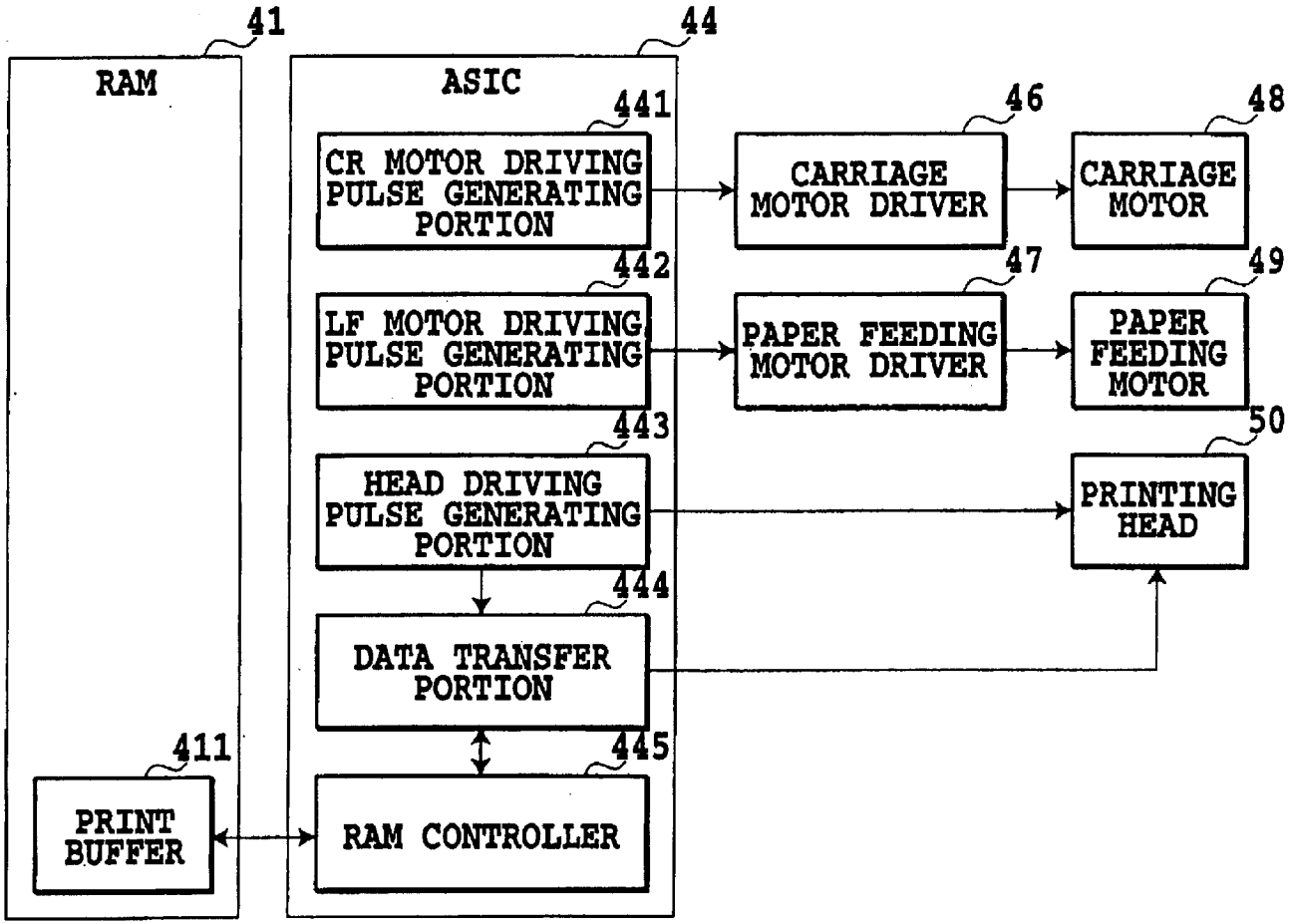
FIG. 5 a block diagram showing a detailed construction of an ASIC shown in FIG. 4.

FIG. 5 is a block diagram for explaining a detailed construction of the control system of ASIC 44.

In FIG. 5, the reference numeral 441 denotes a motor pulse generating portion generating a motor pulse to be a base upon scanning of the printing head. The drive pulse signal controlling the carriage motor 48 from the motor pulse generating portion 441 is transferred to the carriage motor driver 46.

On the other hand, in synchronism with the motor pulse generated by the motor pulse generating portion 441, the foregoing latch signal, the block signal, the ODD/EVEN selection signal, the pulse signal HENB and so on for driving the printing head 50 are transferred from the head drive pulse generating portion 443. At this time, the head drive pulse generating portion 443 transfers a synchronization signal for transferring the ejection data in synchronism with the various drive signals of the printing head, to a data transfer portion 444. Corresponding to this, the data transfer portion 444 transfers the ejection data for one cycle of driving of the electrothermal transducer to the printing head 50.

The ejection data for one cycle stored in the print buffer 411 of RAM 41 is transferred to the data transfer portion 444 via the RAM controller 445. The data transfer portion 444 transfers data to the printing head, and output a signal indicative of completion of transfer to the RAM controller 445. When the transfer completion signal is input to the RAM controller 445, the controller 445 perform transfer of the next ejection data.

It should be appreciated that control of the image data to be transferred to the printing heads can be performed by a program designating a start address and end address (or data transfer amount) of the ejection data for one scan stored in the print buffer 411 of RAM 41.

(Explanation of Generation of Image Data)

Figure 6:
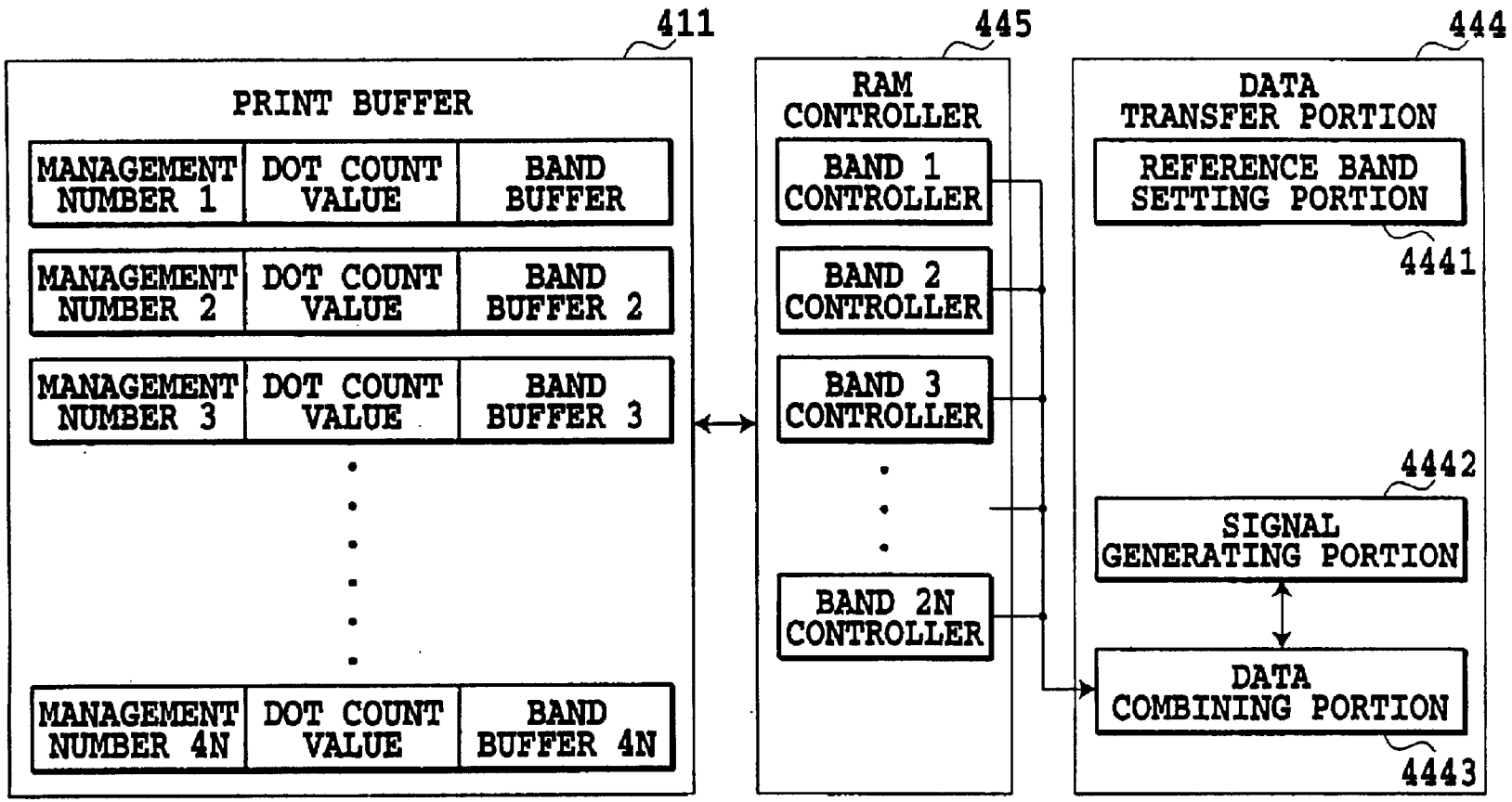
FIG. 6 a block diagram showing a detailed construction of a print buffer, a RAM controller and a data transfer portion shown in FIG. 5.

FIG. 6 is a block diagram for explaining a further detailed construction of the print buffer 411, the RAM controller 445 and the data transfer portion 444.

As shown FIG. 6, the print buffer 411 is managed per a band buffer storing ejection data for eight scanning lines. Assuming that a maximum scanning width (a length in the primary scanning direction) in scanning of the printing head is W pixels (dots), a storage capacity of each band buffer becomes 8×W pixels. Each band buffer is consisted of two buffers (each having storage capacity of 8×W pixels). This is because one buffer is for storing the ejection data for the current printing scan and the other buffer is for storing the ejection data which is to be made reference to in the next printing scan.

Assuming that number of nozzles of the printing head is 16N (N=10 in the shown embodiment), number of band buffers becomes 4N (=(16N/8)×2). On the other hand, in each band buffer, a storage portion for storing an attribute data indicative of attribute is provided. One of the attributes is a band buffer management number 1 to 4N for making reference to. On the other hand, another attribute is number of data to perform ejection among ejection data stored in the band buffer (number of pixel to be printed, hereinafter also referred to as number of dots), which is stored as "dot count value".

In a reference band setting portion 4441 of the data transfer portion 444, management numbers corresponding to the band buffers to perform data transfer are set sequentially. Each band controller in the RAM controller 445 is driven sequentially in order of 1 to 2N, for example. Each band controller reads out the ejection data from the band buffer set the management number in the reference band setting portion 4441 and outputs the read data to a data combining portion 4443 of the data transfer portion 444. The data combining portion 4443 combines the ejection data sequentially transferred from respective band controllers depending upon setting in the reference band setting portion 4441 into the ejection data for one cycle (for one path of scan for the printing head). In the shown embodiment, the printing head has a hundred-sixty ejection openings and respective eight ejection openings in each band. Therefore, when data is transferred from all of the band buffers, data for respective eight ejection openings (for eight dots) from twenty bands, namely data for a hundred-sixty ejection openings (=8×20), are combined to form ejection data for one cycle.

It should be appreciated that the band buffer, for which the management number does not set by the reference band setting portion 4441 does not make reference to the band buffer by the band controller and does not perform data output. In contrast to this, the data combining portion 4443 has a function to handle the data of the band buffer having no output as blank data, and outputs blank data in the signal generating portion 4442 in response thereto. By the way, in the construction set forth above, the ejection data by the (n)th band n controller corresponds to data for the electrothermal transducer of Seg. (8n−7) to Seg. 8n.

[First Embodiment]

Figures 7, 7A:
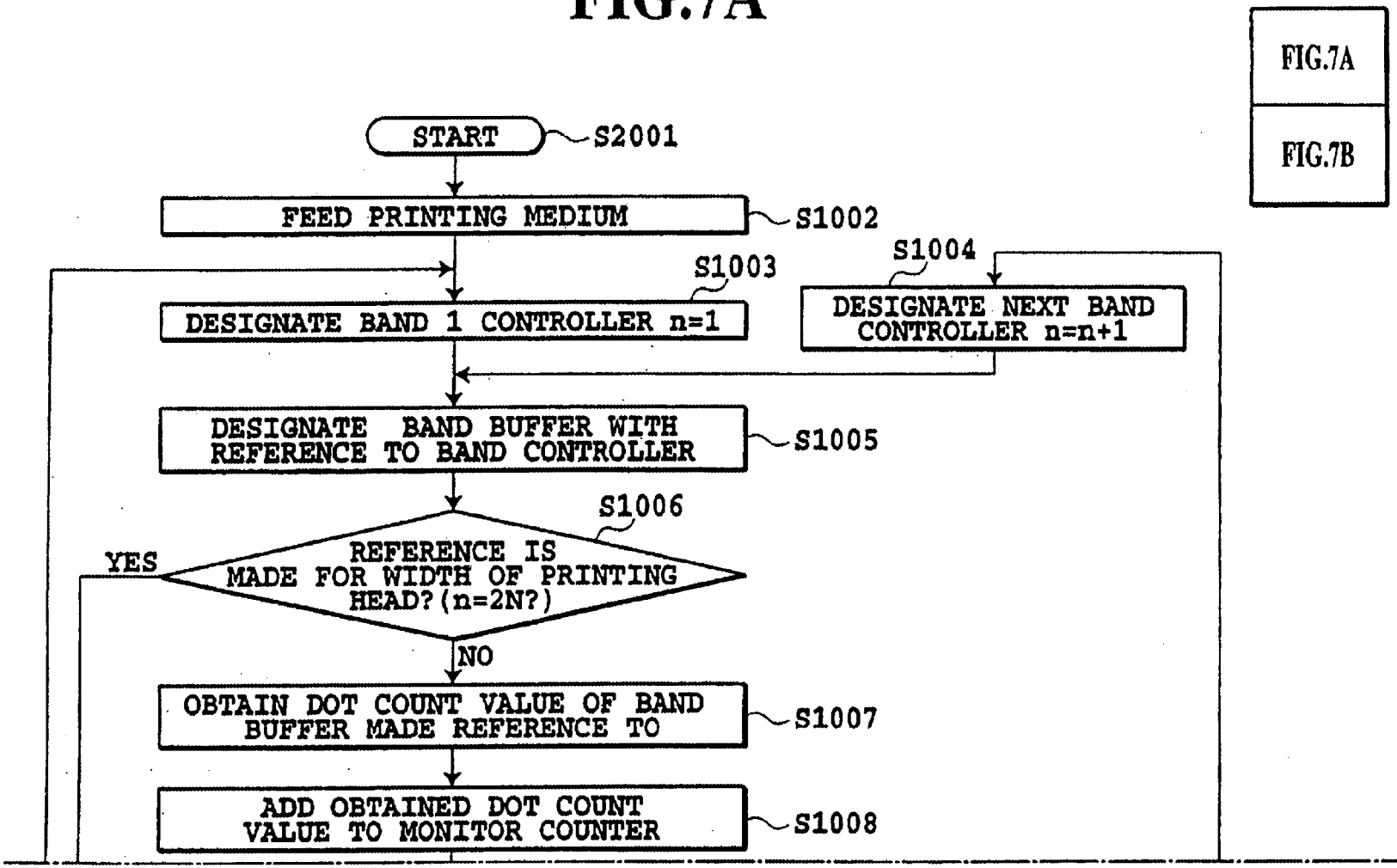
FIG. 7 is a diagram showing the relationship of FIGS. 7A and 7B.
FIG. 7A is flowchart showing a procedure of the first embodiment of print control process according to the present invention.
Figure 7B:
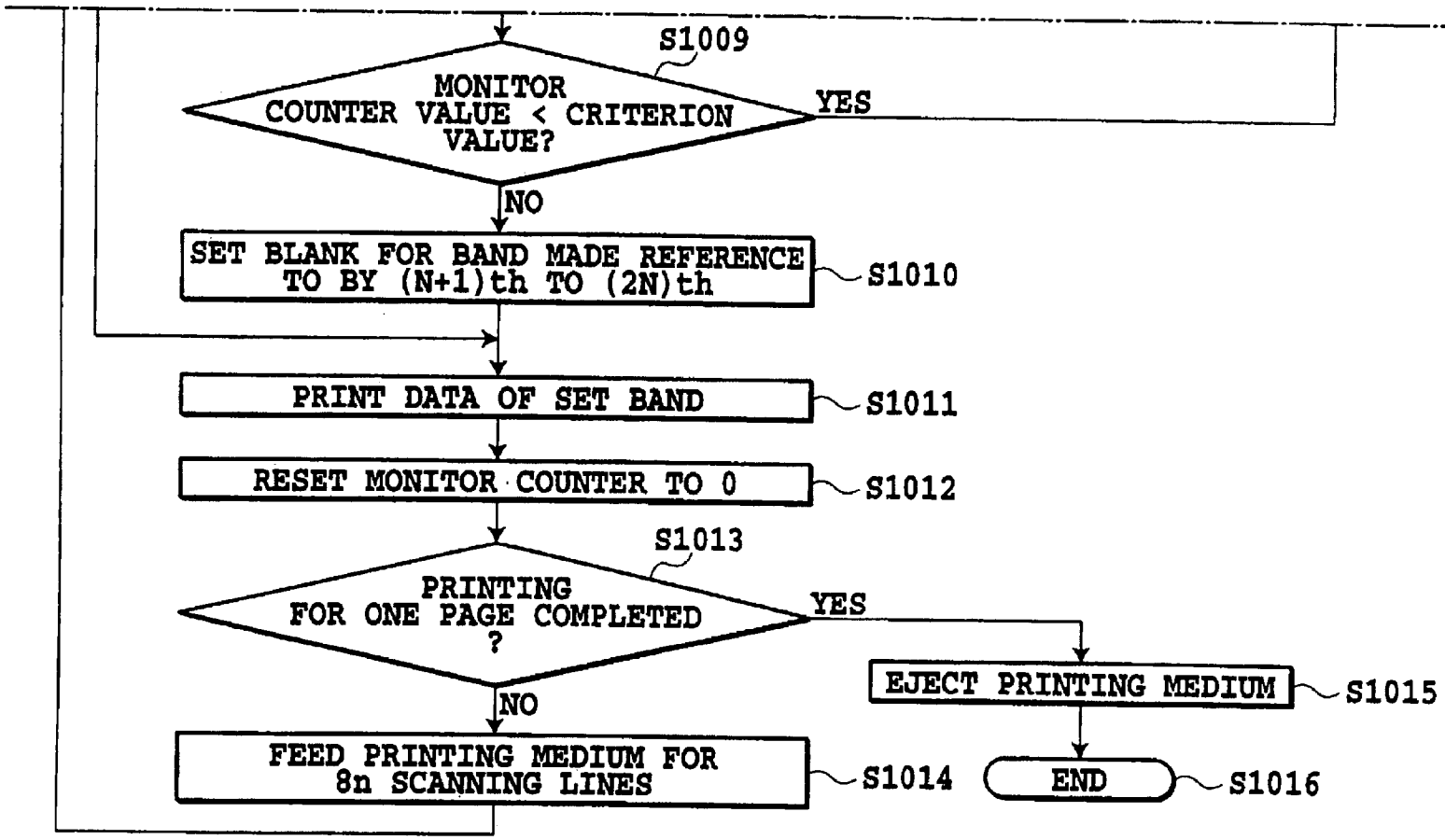
FIG. 7B is flowchart showing a procedure of the first embodiment of print control process according to the present invention.

FIG. 7 is a flowchart showing one embodiment of print control according to the present invention.

In the shown embodiment of print control, the management numbers of the band buffers to be made reference are sequentially set in the reference band setting portion 4441 (S1005). Then, by repeating primary scan (S1011) of the printing head and auxiliary scan (S1014) which is feeding of the printing medium, printing is performed.

When printing is initiated (S1001), a feeding operation (S1002) of the printing medium is performed to feed the printing medium to an initial position to start printing by the printing head. Then, setting of a destination for making reference to the ejection data for transferring to the printing head is performed. Setting of the destination for making reference to is performed by setting the management number of the band buffer into the reference band setting portion 4441. At first, a parameter n is set to 1 for designating the bands 1 controller (S1003). Next, the management number indicative of the destination to make reference to for the band n controller designated by the parameter n (1 in this case) is set in the reference band setting portion 4441 (S1005).

Then, judgment is made whether the destinations for making reference to are set for all of the band controller of 2N of nozzles in the printing head (S1006). At step S1006, judgment is made whether n=2N. If judgment is made that n is not 2N at step S1006, dot count values of the band buffers set as destination for making reference to for the band n controller are obtained (S1007). Next, the obtained dot count value is added to a monitor counter (S1008). Furthermore, check is performed whether the value of the monitor counter is smaller than a predetermined criterion value (S1009).

Here, the criterion value is determined depending upon a capacity of the power source (electric energy consumption allowed for one scan) to be used in the printer. Assuming that the maximum number of printing dots permitted for one scan to be derived on the basis of the power source capacity is Cmax, the criterion value is Cmax−8W.

The reason is that if Cmax per se is taken as the criterion value, number of the printing dots may exceed Cmax. Therefore, the criterion value is set at a value derived by subtracting 8W as the maximum number of data of one band buffer from Cmax.

When the monitor counter value is judged as being smaller than the criterion value, the parameter n is set to n=n+1 for designating the next band buffer (S1004). Then, in judgment of the step S1009, finally, if the monitor counter value is judged as being greater than or equal to the criterion value, the band (n+1) controller to band 2N controller as remaining band controller are not set the destinations to make reference to and thus are set in blank. Accordingly, in this case, the band (n+1) controller to the band 2N controller do not perform output by the foregoing function.

At step S1006, if judgment is made that n=2N or after process at step S1010, ejection data of the set band buffers are combined and transferred to the printing head to performing printing on the printing medium (S1011).

Next, the monitor counter is reset to 0 (S1012), and judgment is made whether output for one page is completed or not (S1013). When outputting for one page is completed, the printing medium is ejected (S1015) and then printing operation is terminated (S1016).

On the other hand, if outputting for one page is not completed, the printing medium is fed for a magnitude corresponding to the number of printed scanning lines 8n, i.e. the width printed at step 1011 (S1014). Then, procedure is returned to step S1003. In the process of steps S1003 to S1015 for next scan, the band controllers are returned to the initial state and are used in sequential order from one of n=1. For the reference band setting portion 441, the management number corresponding to the first band buffer among band buffers, in which blank is set in the preceding scan, is set as the first destination for making reference to. The management number of the destination to make reference to is returned to one next to 4N to sequentially repeat this rotation.

FIG. 8 is an illustration showing a particular example of the shown embodiment of print control.

In the example shown in FIG. 8, similarly to the foregoing, the printing head having 2N=20, namely a hundred-sixty (=8×20) nozzles (accordingly electrothermal transducers), is employed. On the other hand, the maximum scanning width W in the printing scan is assumed to be 2880 pixels, and number of printing dots Cmax permitted for one path of printing scan is assumed to be 230400 (=2880×160/2). With this Cmax, if black solid printing is performed, eighty nozzles which is half of a hundred-sixty nozzles, are driven for one path of scan by the printing head. Since the criterion value is set at Cmax−8W, the criterion value becomes 207360 (=230400−2880×8) dots.

In the example shown in FIG. 8, an image data to be printed is solid printing at 75% of duty ratio and with 2880 pixels of scanning width. In case of this data, 17280 (=2880×8×0.75) dots are expanded in one band buffer. Therefore, the dot count value of each hand buffer becomes 17280 dots.

Aggregating or summing the dot count value in the monitor counter with sequentially assigning band buffers to make reference to for respective band controllers, the value of the monitor counter exceeds 207360 dots as the criterion value at a timing designating the designation to make reference to the band 12 controller of n=12. Therefore, the destinations to make reference to of the remaining band 13 controller to band 20 controller are set in blank.

In this case, a relationship between the uses nozzles (hatched portion) and the printed image position is shown at the center of the drawing. As shown in this drawing, ninety-six (=8×12) electrothermal transducers (printing elements) from the upper end of the nozzle array (the downstream side in the feeding direction of the printing medium is shown in upper side) are enabled and remaining sixty-four (8×8) electrothermal transducers at lower end side are disabled.

At a timing of setting the destinations to make reference to for all band controllers (including blank) or at a timing where printing is completed, the monitor counter is cleared and reset to zero. Then, after completion of printing set forth above, the printing medium is fed in a magnitude corresponding to ninety-six scanning lines.

As set forth above, the printing operation and transporting operation are repeated.

In case of FIG. 8, the uniform solid image is printed over the entire surface, aggregating or summing condition of the monitor counter is the same over respective printing scans. Also, number of nozzles to be used is constant. On the other hand, as can be appreciated from a relationship between the used nozzles and the printing image position, printing is performed so that the upper end of the image to be printed in the next scan is adjoined with the lower end of the printed image.

On the other hand, in the drawing, setting of the destination to make reference to for the band 5 controller for the fourth printing scan is returned to the band buffer 1. This is because, in the shown embodiment, the print buffer is managed as forty band buffers, and the ejection data is expanded with sequential rotation of forty band buffers.

In case of the shown embodiment, when the image data is for the image of 2880 pixels in width and 9600 pixels in length, a hundred times (=9600/(8×12)) of printing scan is performed. In contrast to this, in the case of conventional printing by dividing into half, a hundred-twenty times (=9600/160×2) of printing scan is performed. As set forth above, in the shown embodiment, when normal and general image is printed, possible largest number of scanning lines can be printed within the range of electric energy consumption permitted for one scan to enable efficient printing with restricted power consumption.

[Second Embodiment]

The foregoing first embodiment is mainly intended to restrict power consumption, in contrast to this, the second embodiment relates to a print control mainly for restricting elevating of temperature of the printing head.

Figure 9:
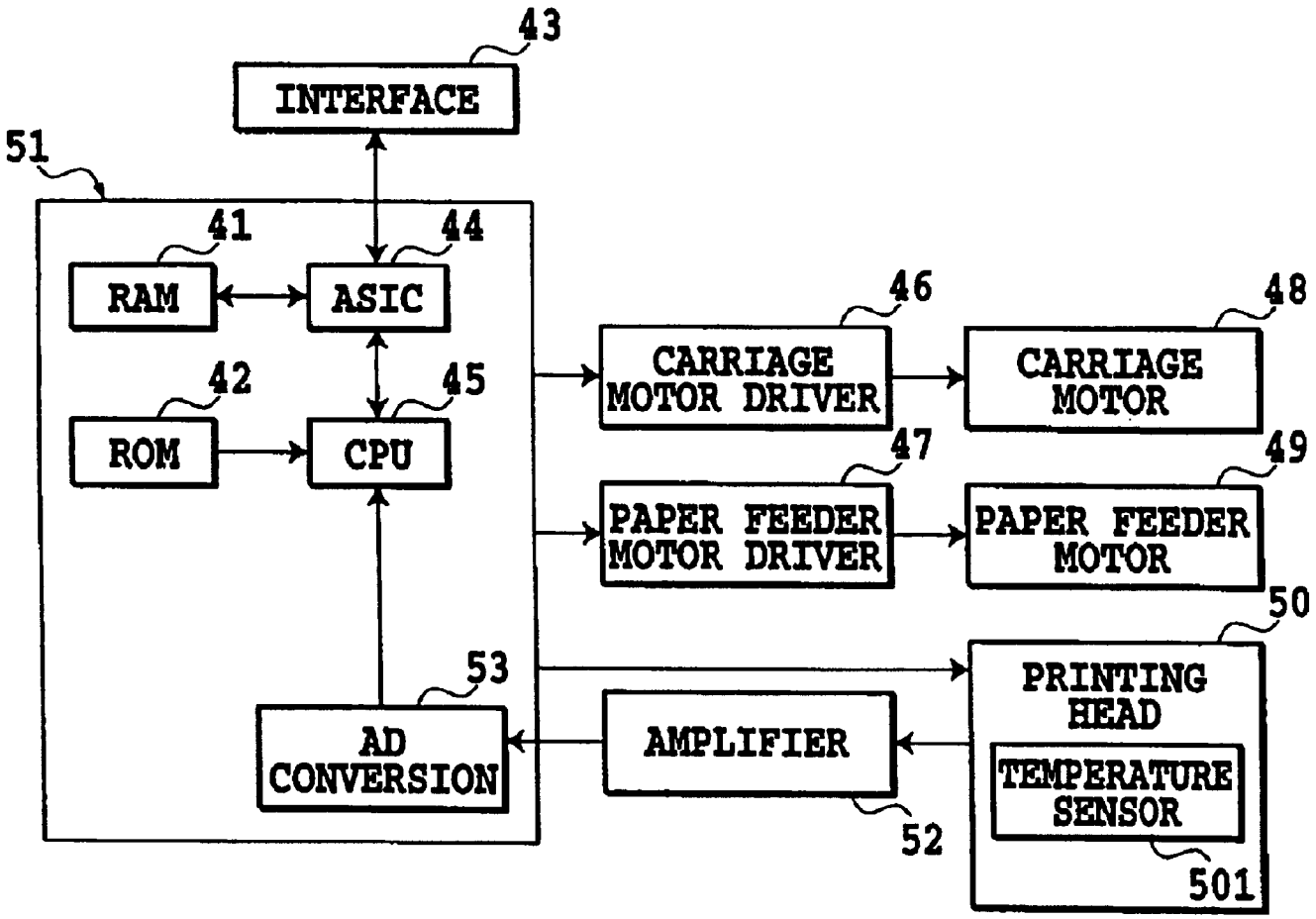
FIG. 9 is a block diagram showing a construction of the second embodiment of a control system according to the present invention.

FIG. 9 is a block diagram showing a construction of the control system for implementing this embodiment of print control.

In the shown construction of the control system, different from the construction shown in the foregoing first embodiment, a printing head 50 is provided with a temperature sensor 501. An output of the temperature sensor 501 is input to CPU 45 via an amplifier 52 and an A/D converter 53.

A head temperature, which the shown embodiment of the printing head permits, is assumed as Tmax [° C.], and elevation of temperature upon printing for 2NW (=2×N×W) in one printing scan is assumed as ΔTfull [deg.]. Then, the following relationship is established.

Temperature elevation ΔT of the head in the case where printing is performed with dot number C for one printing scan, becomes $$\Delta T \neq (\Delta T\text{full}) \times (C/2NW)$$

When the head temperature before printing scan is Ttemp [° C.], in order to restrict the head temperature upon printing scan to be lower than or equal to the allowable highest temperature.

$$T\text{temp} + \Delta T < T\text{max}$$

has to be satisfied.

Namely, number of dots satisfying ΔT≠(ΔTfull)×(C/2NW)<(Tmax−Ttemp), and thus C<(2NW)×(Tmax−Ttemp)/(ΔTfull) is preferred. This may be done by restricting number of the printing dots permitted in one printing scan to be less than or equal to C.

Figures 10, 10A:
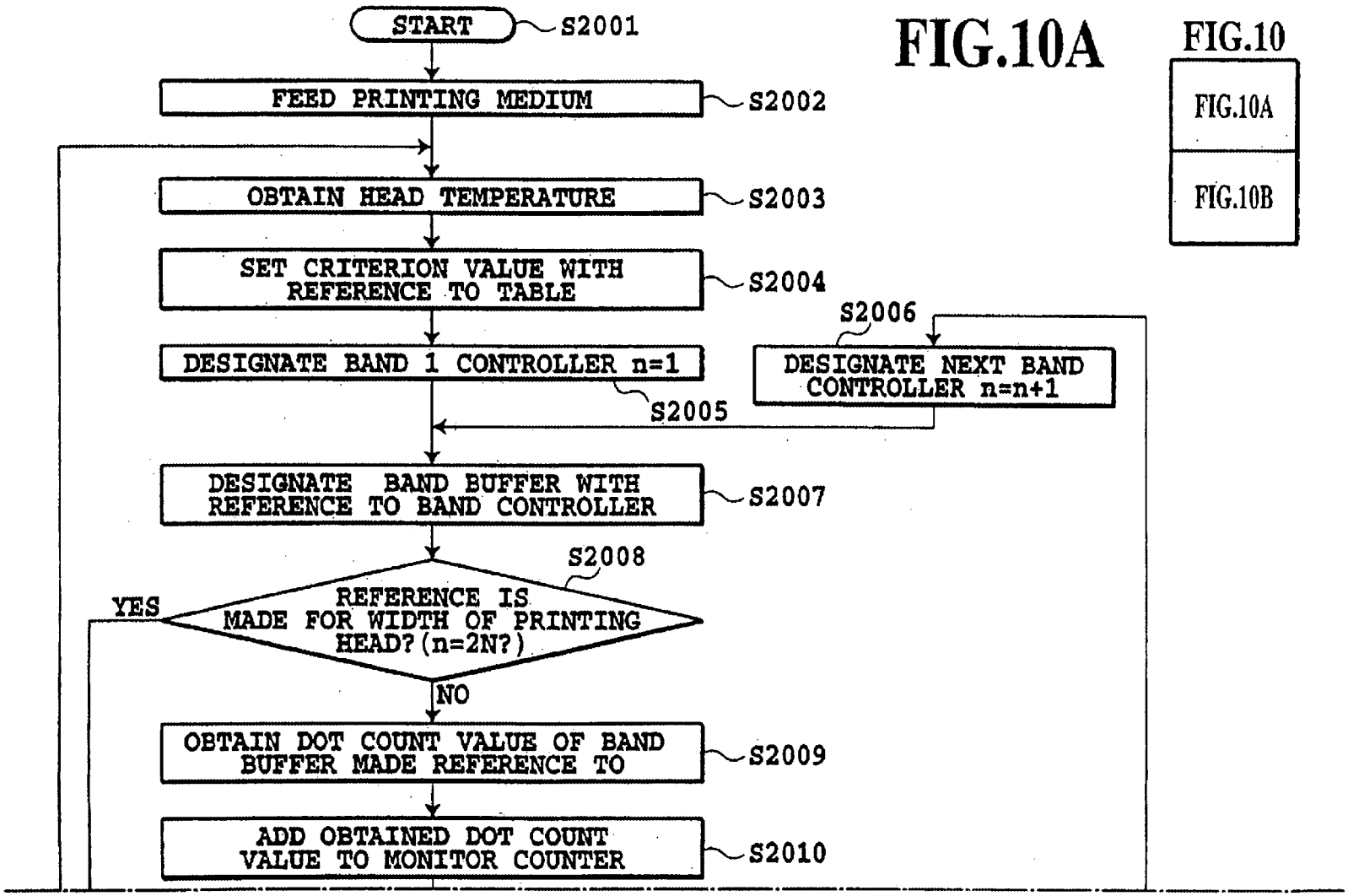
FIG. 10 is a diagram showing the relationship of FIGS. 10A and 10B.
FIG. 10A is flowchart showing a process procedure of the second embodiment of a print control according to the present invention.
Figure 10B:
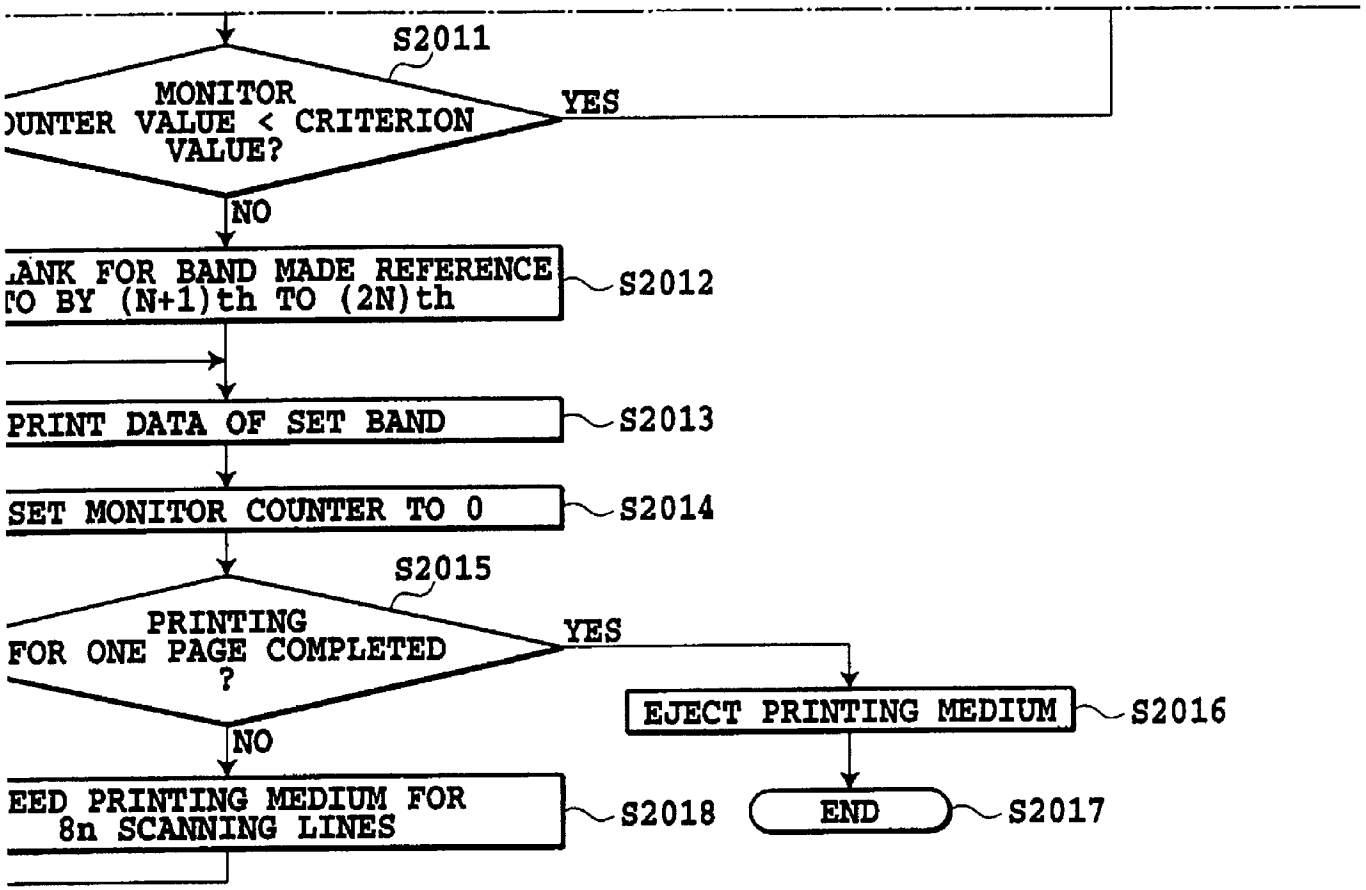
FIG. 10B is flowchart showing a process procedure of the second embodiment of a print control according to the present invention.

FIG. 10 is a flowchart showing the second embodiment of print control according to the present invention. In the shown embodiment, before designating the band 1 controller (S2005), obtaining of the printing head temperature is performed (S2003). With making reference to the table shown below on the basis of the obtained head temperature, the criterion value to be used at step S2011 is set (S2004).

When Cmax is set at C as set forth above:

| | |
|---|---|
| Printing head temp. ≦9° C. | Criterion value: Cmax-8W |
| Printing head temp. 10~19 | Criterion value: Cmax-8W |
| Printing head temp. 20~29 | Criterion value: Cmax-8W-C1 |
| Printing head temp. 30~39 | Criterion value: Cmax-8W-C2 |
| Printing head temp. 40~49 | Criterion value: Cmax-8W-C3 |
| Printing head temp. 50~59 | Criterion value. Cmax-8W-C4 |
| Printing head temp. 60~69 | Criterion value: Cmax-8W-C5 |
| Printing head temp. 70~79 | Criterion value: Cmax-8W-C6 |
| Printing head temp. ≧80 | Criterion value: Cmax-8W-C7 |

wherein 8W is the same as that in the first embodiment, and C1, C2, C3, C4, C5, C6 and C7 are respectively given integer and C1<C2<C3<C4<C5<C6<C7.

The process of the step S2005 and subsequent steps are the same as the foregoing first embodiment. Therefore, further and redundant explanation will be omitted.

As set forth above, in the second embodiment, since the temperature sensor 501 detecting the temperature of the printing head is further provided to vary the criterion value to be compared with the monitor count value depending upon the detected temperature of the printing head. Therefore, the heating value associated with printing operation of the printing head can be optimally restricted.

[Third Embodiment]

In the foregoing embodiments, the monitor counter value is aggregated or summed at the same time of designating the reference band buffer to the band controller, it has been set to use the nozzle from the upper end of the nozzle array. However, in advance of setting of the destination to make reference to of the band controller, the dot count value of the band buffer as destination for making reference to is aggregated or summed by the monitor counter, it becomes possible to set to use the nozzle array from the lower end side.

FIG. 11 is an illustration for explaining a particular example of printing under control of the shown embodiment.

In the shown embodiment, similarly to the first embodiment, the printing head of 2N=20 is employed. The maximum scanning width W is set 2880 pixels and the criterion value is set at 207360 pixels. The image data to be printed is the solid image of 75% duty ratio and 2880 pixel width similarly to the first embodiment.

At the center of FIG. 11, a relationship between the used nozzle and the printed image position is shown similarly to the above.

Figures 12, 12A:
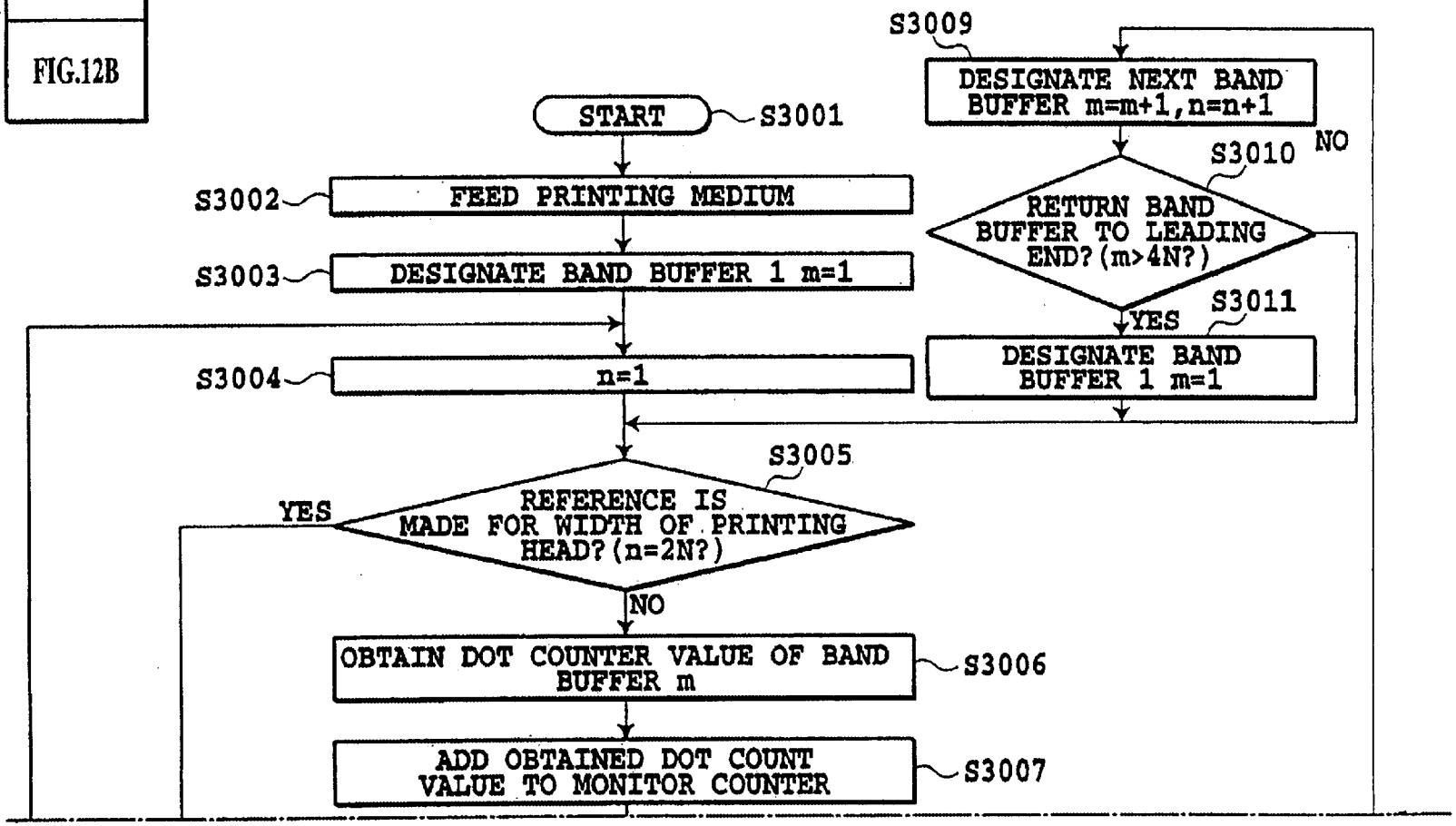
FIG. 12 is a diagram showing the relationship of FIGS. 12A and 12B.
FIG. 12A is flowchart showing a process procedure of the third embodiment of a print control according to the present invention.
Figure 12B:
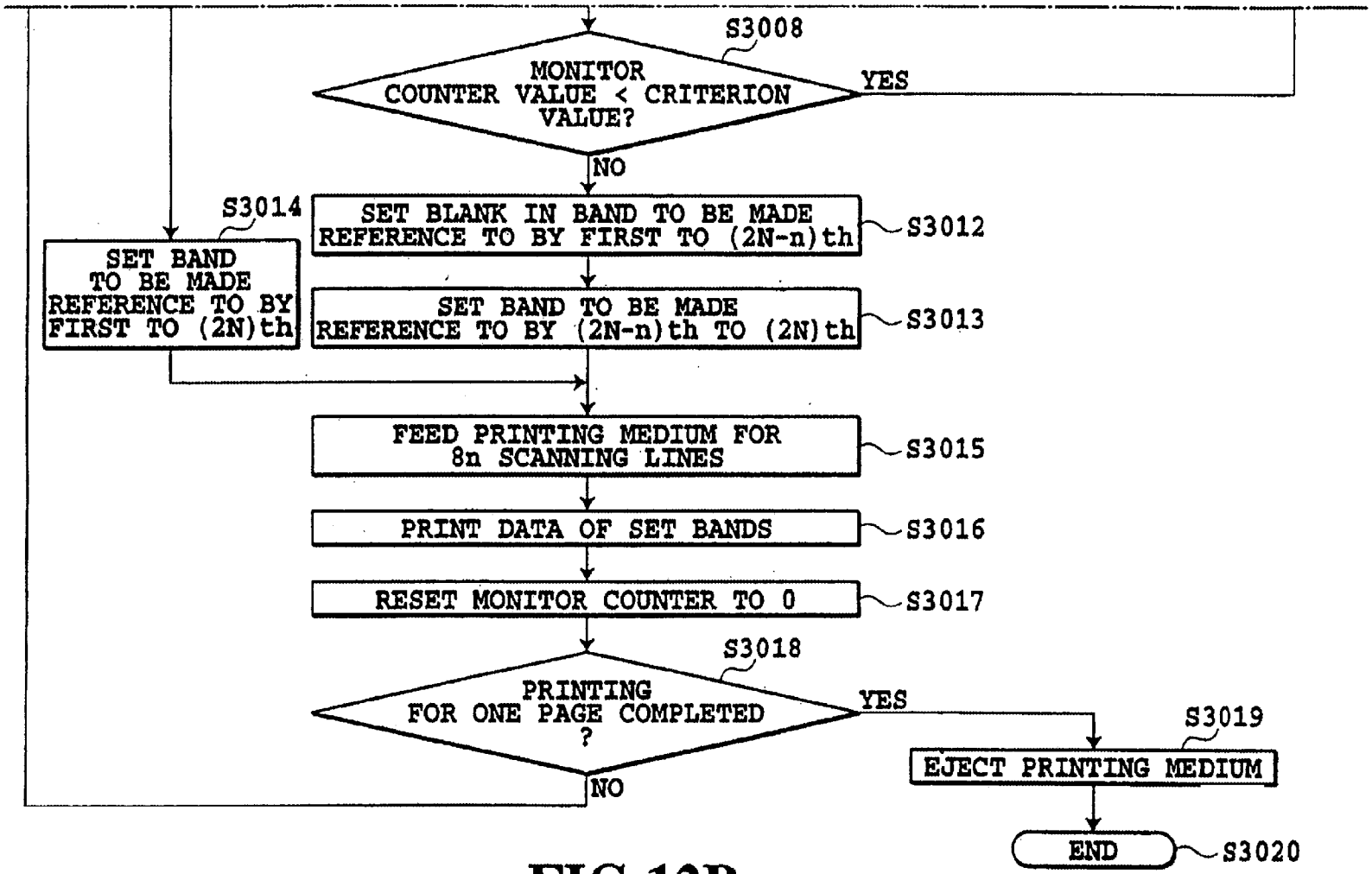
FIG. 12B is flowchart showing a process procedure of the third embodiment of a print control according to the present invention.

FIG. 12 is a flowchart showing the third embodiment of print control according to the present invention.

A dot count value is obtained from the band buffer m (S3006). The monitor counter is aggregated or summed (S3007). Here, m to be managed is an integer in a range of 1 to 4N. Then, judgment is made whether the monitor counter value is less than the criterion value or not.

When the monitor counter value is less than the criterion value, next band buffer is designated (S3009). Here, if the management number m is in excess of 4N which is the maximum value of the management number of the band buffer, the band buffer 1 is designated (S3011). On the other hand, when the value of the monitor counter is greater than or equal to the criterion value, blanks are set to the band 1 controller to the bans (2N−n) controller (S3012). Furthermore, the band buffers to make reference to are set from the band (2N−n+1) controller to the band 2N controller (S3013).

By the control set forth above, setting is made to use the nozzles from the lower end of the nozzle array.

On the other hand, at step S3005, check is made number of band buffers made reference to the dot count value reaches 2N of the nozzle width, or not. If the answer is positive, the band buffers to make reference to are set to the band 1 controller to the band 2N controller (S3014). Next, after feeding the printing medium for 8n of printing scanning lines of the ejection data to be printed (S3015), printing with the ejection data of the set band buffers is performed (S3016). By the processes of steps S3015 and S3016, images can be completed to adjoining the upper and lower ends of the used nozzles between respective printing scans. Furthermore, the monitor counter is reset to zero (S3017). After resetting, check is performed whether outputting for one page is completed or not (S3018). If outputting for one page is completed, the printing medium is ejected (S3019) to terminate printing (S3020). If outputting for one page is not yet completed, the process is returned to step S3004 to set the reference number of the print buffer to one.

[Other Embodiment]

In respective of the foregoing embodiments, thermal ink-jet system printing element is employed, effective effect can be attained even in application of the present invention for other printing systems as long as electrically driven printing elements are employed. For example, the present invention is of course applicable for heat sensitive type thermal printer employing electrothermal transducer in the printing elements, ink-jet printing apparatus employing piezoelectric actuator elements in the printing elements, and so on.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. This system can particularly be applied to on-demand type ink jet recording systems. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A printing apparatus employing a printing head having a plurality of printing elements for performing printing by scanning the printing head relative to a printing medium, said printing apparatus comprising:

counting means for summing printing dots, wherein each of the printing elements is selectively driven to eject ink for forming said dots based on printing data, and wherein said data is arranged in one or more bands, said counting means summing, as a unit and prior to scanning of the printing head, a number of printing dots to be printed as identified in a said band of printing data;

judgment means for making judgment as to whether the number of printing dots summed by the counting means is in excess of a predetermined value; and print control means for selecting a group of one or more bands of printing data to be printed during one scanning, depending upon judgment of the judgment means, said print control means performing printing in a printing scan by the printing elements corresponding to the selected group of one or more bands of printing data.

2. A printing apparatus as claimed in claim 1, wherein the print control means adds, prior to performing the printing, one or more bands of printing data, in turn, to the selected group of one or more bands of printing data, and wherein said print control means only adds the one or more bands of printing data if doing so would not make a total number of printing dots summed by the counting means exceed the predetermined value as determined by the judgment means.

3. A printing apparatus as claimed in claim 1 or 2, which further comprises temperature detecting means for detecting a temperature of the printing head, wherein the predetermined value is varied depending upon the temperature of the printing head detected by the temperature detecting means.

4. A printing apparatus as claimed in claim 1, wherein the print control means further comprises transport control means for feeding a printing medium for a region corresponding to the group of one or more bands of printing data selected in the printing scan.

5. A printing apparatus as claimed in claim 4, wherein the counting means sequentially executes summing from a band of printing data arranged on a downstream side in the feeding direction of the printing medium, and the transport control means performs feeding of the printing medium after printing by the print control means.

6. A printing apparatus as claimed in claim 4, wherein the counting means sequentially executes summing from a band of printing data arranged on an upstream side in the feeding direction of the printing medium, and the transport means performs feeding of the printing medium in advance of printing by the print control means.

7. A printing apparatus as claimed in claim 4, wherein the printing head generates a bubble in ink using thermal energy for ejecting the ink by pressure of the bubble for performing printing.

8. A printing apparatus as claimed in claim 1, wherein the printing head generates a bubble in ink using thermal energy for ejecting the ink by pressure of the bubble for performing printing.

9. A printing apparatus as claimed in claim 1, further comprising holding means for holding the number of dots to be printed corresponding to each respective band of printing data summed by the counting means.

10. A printing apparatus as claimed in claim 9, further comprising:

a band controller for reading out the data from respective bands of printing data; and setting means for setting one or more indexes corresponding to band buffers in accordance with judgment by said judgment means, the band buffers memorizing the data to be read by the band controller, wherein the setting means does not set indexes of band buffers when judgment is made by said judgment means that a total number of dots summed by the counting means exceeds the predetermined value.

11. A printing apparatus as claimed in claim 1, wherein each said band of printing data is controlled by a band controller that controls the printing data for each band.

12. A printing method employing a printing head having a plurality of printing elements for performing printing by scanning the printing head relative to a printing medium, said printing method comprising:

a counting step of summing printing dots, wherein each of the printing elements is selectively driven to eject ink for forming said dots based on printing data, and wherein said data is arranged in one or more bands, said counting step summing, as a unit and prior to scanning of the printing head, a number of printing dots to be printed as identified in a band of printing data;

a judgment step of making judgment as to whether the number of printing dots summed in the counting step is in excess of a predetermined value; and a printing step of selecting a group of one or more bands of printing data to be printed during one scanning, depending upon the judgment, said printing step performing printing in a printing scan by the printing elements corresponding to the selected group of one or more bands of printing data.

13. A printing method as claimed in claim 12, wherein in the printing step, prior to performing printing, one or more bands of printing data are added, in turn, to the selected group of one or more bands of printing data, and wherein the one or more bands of printing data are only added in the printing step if doing so would not make a total number of printing dots summed by in the counting step exceed the predetermined value as determined in the judgment step.

14. A printing method as claimed in claim 12, which further comprises a feeding step, of feeding a printing medium for a region corresponding to the group of one or more bands of printing data selected in the printing scan.

15. A printing method as claimed in claim 14, wherein the summing is sequentially executed from a band of printing data arranged on a downstream side in the feeding direction of the printing medium, and the feeding step performs feeding of the printing medium after printing by the printing step.

16. A printing method as claimed in claim 14, wherein the summing is sequentially executed from a band of printing data arranged on an upstream side in the feeding direction of the printing medium, and the feeding step performs feeding of the printing medium in advance of printing by the print step.

17. A printing method as claimed in claim 14, wherein the printing head generates a bubble in ink using thermal energy for ejecting the ink by pressure of the bubble for performing printing.

18. A printing method as claimed in claim 12 or 13, which further comprises a step of detecting a temperature of the printing head, wherein the predetermined value is varied depending upon the detected temperature of the printing head.

19. A printing method as claimed in claim 12, wherein the printing head generates a bubble in ink using thermal energy for ejecting the ink by pressure of the bubble for performing printing.

20. A printing method as claimed in claim 12, further comprising a holding step of holding the number of dots to be printed corresponding to each respective band of printing data summed in the counting step.

21. A printing method as claimed in claim 20, further comprising:

a reading out step of reading out the data from respective bands of printing data; and a setting step of setting one or more indexes corresponding to band buffers in accordance with the judgment step, the band buffers memorizing the data to be read by the band controller, wherein the setting step does not set indexes of band buffers when judgment is made in the judgment step that a total number of dots summed in the counting step exceeds the predetermined value.

22. A printing apparatus as claimed in claim 12, wherein each said band of printing data is controlled by a band controller that controls the printing data for each band.

23. A printing apparatus employing a printing head having a plurality of printing elements for performing printing by scanning the printing head relative to a printing medium, said printing apparatus comprising:

counting means for summing printing dots, wherein each of the printing elements is selectively driven to eject ink for forming said dots based on printing data, and wherein said data is arranged in one or more bands, said counting means summing, for each band and prior to scanning of the printing head, a number of printing dots to be printed as identified in a said band of printing data, wherein each said band corresponds to data for one scan by a plurality of printing elements in the printing head;

judgment means for making judgment as to whether the number of printing dots summed by the counting means is in excess of a predetermined value; and print control means for selecting a group of one or more bands of printing data to be printed during one scanning, depending upon judgment of the judgment means, said print control means performing printing in a printing scan by the printing elements corresponding to the selected group of one or more bands of printing data.

24. A printing apparatus as claimed in claim 23, wherein each said band of printing data is controlled by a band controller that controls the printing data for each band.

25. A printing method employing a printing head having a plurality of printing elements for performing printing by scanning the printing head relative to a printing medium, said printing method comprising:

a counting step of summing printing dots, wherein each of the printing elements is selectively driven to eject ink for forming said dots based on printing data, and wherein said data is arranged in one or more bands, said counting step summing, for each band and prior to scanning of the printing head, a number of printing dots to be printed as identified in a band of printing data, wherein each said band corresponds to data for one scan by a plurality of printing elements in the printing head;

a judgment step of making judgment as to whether the number of printing dots summed in the counting step is in excess of a predetermined value; and a printing step of selecting a group of one or more bands of printing data to be printed during one scanning, depending upon the judgment, said printing step performing printing in a printing scan by the printing elements corresponding to the selected group of one or more bands of printing data.

26. A printing apparatus as claimed in claim 25, wherein each said band of printing data is controlled by a band controller that controls the printing data for each band.

* * * * *

UNITED STATES PATENT AND TRADEMARK OFFICE

CERTIFICATE OF CORRECTION

PATENT NO. : 6,828,995 B1
DATED : December 7, 2004
INVENTOR(S) : Osamu Iwasaki et al.

It is certified that error appears in the above-identified patent and that said Letters Patent is hereby corrected as shown below:

Column 1,
Line 16, "printer" should read -- a printer --; and
Line 59, "other" should read -- another --.

Column 2,
Line 13, "control." should read -- controls: --;
Line 15, "speed." should read -- speeds. --;
Line 23, "complicate." should read -- complicated. --; and
Line 51, "band" should read -- a band --.

Column 5,
Line 8, "a" (second occurrence) should be deleted;
Line 22, "nozzle," should read -- nozzles, --;
Line 49, "hold" should read -- holds --;
Line 61, "respective" should read -- respectively --; and
Line 66, "each" should read -- each of --; and "are" should read -- is --.

Column 6,
Line 23, "signal" should read -- signals --;
Line 31, "hundred-sixty" should read -- one hundred sixty --;
Line 46, "signal" should read -- signals --; and
Line 47, "signal," should read -- signals, --.

Column 7,
Line 39, "output" should read -- outputs --; and
Line 42, "perform" should read -- performs --.

Column 8,
Line 13, "set" should read -- set by --;
Line 29, "does" should read -- is --;
Line 43, "made reference" should read -- referenced --;
Line 57, "bands" should read -- band --; and
Line 63, "controller" should read -- controllers --.

Column 9,
Line 38, "1011" should read -- S1011 --.

Column 10,
Line 9, "uses" should read -- used --.

UNITED STATES PATENT AND TRADEMARK OFFICE

CERTIFICATE OF CORRECTION

PATENT NO. : 6,828,995 B1
DATED : December 7, 2004
INVENTOR(S) : Oasamu Iwasaki et al.

It is certified that error appears in the above-identified patent and that said Letters Patent is hereby corrected as shown below:

Column 11,
Line 8, "≠" should read -- ≒ --; and
Line 15, "≠" should read -- ≒ --.

Column 12,
Line 28, "made" should read -- made of the --;
Line 29, "made reference to" should read -- as to whether --;
Line 37, "adjoining" should read -- adjoin --; and
Line 46, "Embodiment" should read -- Embodiments --.

Column 16,
Line 13, "by" should be deleted.

Signed and Sealed this

Twenty-third Day of August, 2005

JON W. DUDAS
*Director of the United States Patent and Trademark Office*